US010577874B2

(12) United States Patent
Poe et al.

(10) Patent No.: US 10,577,874 B2
(45) Date of Patent: Mar. 3, 2020

(54) CASING DRILLING APPARATUS AND SYSTEM

(71) Applicant: National Oilwell DHT, LP, Houston, TX (US)

(72) Inventors: Stephen B. Poe, Guthrie, OK (US); Jose Chiarello, Mendoza (AR); Hector Nunez, Mendoza (AR)

(73) Assignee: National Oilwell DHT, LP, Houston, TX (US)

( * ) Notice: Subject to any disclaimer, the term of this patent is extended or adjusted under 35 U.S.C. 154(b) by 28 days.

(21) Appl. No.: 15/792,337

(22) Filed: Oct. 24, 2017

(65) Prior Publication Data

US 2018/0112471 A1 Apr. 26, 2018

Related U.S. Application Data

(60) Provisional application No. 62/413,171, filed on Oct. 26, 2016.

(51) Int. Cl.

| | |
|---|---|
| ***E21B 17/06*** | (2006.01) |
| ***E21B 47/01*** | (2012.01) |
| ***E21B 17/10*** | (2006.01) |
| ***E21B 7/20*** | (2006.01) |
| *E21B 47/024* | (2006.01) |
| *E21B 47/18* | (2012.01) |

(52) U.S. Cl.

CPC ..... *E21B 17/06* (2013.01); *E21B 7/20* (2013.01); *E21B 17/10* (2013.01); *E21B 17/1078* (2013.01); *E21B 47/01* (2013.01); *E21B 47/024* (2013.01); *E21B 47/18* (2013.01)

(58) Field of Classification Search

CPC ..... E21B 7/20; E21B 17/06; E21B 17/1078; E21B 17/10; E21B 47/01; E21B 47/18; E21B 47/024

See application file for complete search history.

(56) References Cited

U.S. PATENT DOCUMENTS

| | | | | |
|---|---|---|---|---|
| 5,184,692 | A * | 2/1993 | Moriarty | E21B 23/02 175/50 |
| 6,148,912 | A * | 11/2000 | Ward | E21B 21/08 166/250.07 |
| 8,276,689 | B2 * | 10/2012 | Giroux | E21B 7/20 175/171 |
| 2004/0124015 | A1 | 7/2004 | Vail, III et al. | |
| 2004/0149431 | A1 | 8/2004 | Wylie et al. | |
| 2007/0056771 | A1 * | 3/2007 | Gopalan | E21B 47/187 175/40 |
| 2012/0006567 | A1 | 1/2012 | Giroux et al. | |
| 2015/0144335 | A1 | 5/2015 | Eriksen | |
| 2016/0326807 | A1 * | 11/2016 | Jerez | E21B 7/04 |

* cited by examiner

*Primary Examiner* — Yong-Suk Ro

(74) *Attorney, Agent, or Firm* — Phillips Murrah PC; Martin G. Ozinga

(57) ABSTRACT

A casing drilling with a removable MWD tool comprising a float shoe for removably positioning the bottom of a MWD tool at and or near the drill bit inside the casing, a stabilizer attached to the top of the MWD tool for centrally positioning the MWD tool inside the casing, and a spear positioned on the stabilizer for attaching to retrieval equipment known in the art and also contemplated that after the well is drilled with casing pipe and ready for the production process, a retrieval operation may be lowered into the well to retrieve the MWD tool by attaching to the spear.

5 Claims, 5 Drawing Sheets

CASING DRILLING APPARATUS AND SYSTEM

CROSS-REFERENCE TO RELATED APPLICATIONS

Priority is claimed from provisional patent application U.S. Ser. No. 62/413,171 filed on Oct. 26, 2016 and incorporated by referenced herein.

BACKGROUND OF INVENTION

1. Field of the Invention

In general, the present invention relates to a device, system and method of casing while drilling for oil and gas utilizing a measurement while drilling tool. More particularly, the present invention provides a system to position a measurement while drilling tool in the casing while drilling with the casing and retrieve the same without bringing up the casing to the surface.

2. Description of the Prior Art

Most oil and gas wells are typically drilled with drill pipe and then later cased in with a type of pipe referred to as casing. It is also known to not use drill pipe, but to actually drill with casing, which is sometimes referred to as casing drilling or casing while drilling (CWD). The main purpose of casing drilling is to eliminate classic casing runs and isolate formations while drilling. By using standard casing string instead of conventional drill string, the drilling and casing are executed simultaneously, section by section. Casing while drilling is also a hazard mitigation solution, having applicability in drilling soft shallow sections with high bore hole instability and known losses.

Casing while drilling is more efficient because it is essentially two operations in one with each meter drilled and cased at the same time. Further, it reduces time for tripping in and out as well as the risk involved with such. Still further, it reduces drilling time, cementing time, and overall non-productive time.

Casing while drilling does present other challenges over standard drilling operations. Whereas a drill string in conventional operations is pulled up out of the well at some point, the casing while drilling pipe is never pulled up meaning that the drill bit is permanently left in the hole. Furthermore, all drilling operations require some type of downhole tool for determining where the drilling is and going. MWD stands for "measurement while drilling" in the oil and gas industry. The trajectory of the drilling obviously needs to be determined as well as specific information such as direction, angle, and downhole conditions and MWD tools are utilized to provide this information.

In the prior art utilizing drill pipe, MWD tools are installed as part of the bottom hole assembly (BHA) near the drill bit. The tools are either contained inside a thick walled, drill collar or they are built directly into the collars at a factory prior to arriving on the drilling location. Most MWD tools have a diameter of about the same size of a drill string, which may be around 3½ inches although other sizes are known. After the drilling is complete, the drill pipe is removed from well along with the MWD tool before the casing and well production starts. It is not desirable to leave the tool permanently at the bottom of the well.

Casing are of a larger diameter than the drill string by logical definition. It is not uncommon for casing near the bottom of the well to be at least 5½ inches and more typically 6½ inches.

Thus, there is a need for a system that allows a standard MWD tool to be placed in a casing while drilling operation and allows the MWD tool to be removed from the bottom of the well without pulling the casing from the well. The above discussed limitations in the prior art is not exhaustive. The current invention provides an inexpensive, time saving, more reliable apparatus and method of utilizing a MWD tool in a casing while drilling operation where the prior art fails.

SUMMARY OF THE INVENTION

In view of the foregoing disadvantages inherent in the known types of equipment and methods of use now present in the prior art, the present invention provides a new and improved apparatus, system, and method of use that provides a retrieval system for a MWD tool from a casing while drilling operation. As such, the general purpose of the present invention, which will be described subsequently in greater detail, is to provide a new and improved remote casing while drilling system apparatus and method of using the same, which has all the advantages of the prior art devices and none of the disadvantages.

It is, therefore, contemplated that the present invention may provide a float shoe for removably positioning the bottom of a MWD tool at and or near the drill bit, a stabilizer attached to the top of the MWD tool for centrally positioning the MWD tool inside the casing, and a spear positioned on the stabilizer for attaching to retrieval equipment known in the art. It is contemplated that after the well is drilled and ready for the production process, a retrieval operation may be lowered into the well to retrieve the MWD tool by attaching to the spear. The drill bit may be left in the bottom of the well and well production started.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved casing while drilling apparatus, system and method for retrieving a MWD tool as well as the removable positioning of the MWD tool in the larger diameter casing.

Furthermore, an object of the present invention is to provide a new and improved casing while drilling apparatus, system and method for retrieving a MWD tool, which may be easily and efficiently utilized, manufactured and marketed.

Another object of the present invention is to provide a new and improved casing while drilling apparatus, system and method for retrieving a MWD tool that provides a retrieval without the need to raise the drilling operation out of the hole.

It is a further object of the present invention to provide a new and improved casing while drilling apparatus, system and method for retrieving a MWD tool, which is of a durable and reliable construction and may be utilized in numerous applications.

An even further object of the present invention is to provide a new and improved casing while drilling apparatus, system and method for retrieving a MWD tool, which is susceptible to a low cost of use, which accordingly is then susceptible to low prices of sale to the consuming industry, thereby making such a system economically available to those in the field.

Still another object of the present invention is to provide a new and improved casing while drilling apparatus, system and method for retrieving a MWD tool, which provides all of the advantages of the prior art while simultaneously overcoming some of the disadvantages normally associated therewith.

Another object of the present invention is to provide a new and improved casing while drilling apparatus, system and method for retrieving a MWD tool that does not damage the tool and still allows for leaving the drill bit in the hole.

Yet another object of the present invention is to provide a new and improved casing while drilling apparatus, system and method for retrieving a MWD tool that may utilize known downhole retrieval systems.

These, together with other objects of the invention, along with the various features of novelty, which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE PICTORIAL ILLUSTRATIONS, GRAPHS, DRAWINGS, AND APPENDICES

The invention will be better understood and objects other than those set forth above will become apparent when consideration is given to the following detailed description thereof. Such description makes reference to the annexed pictorial illustrations, graphs, drawings and appendices.

DETAILED DESCRIPTION OF INVENTION

Figure 1:
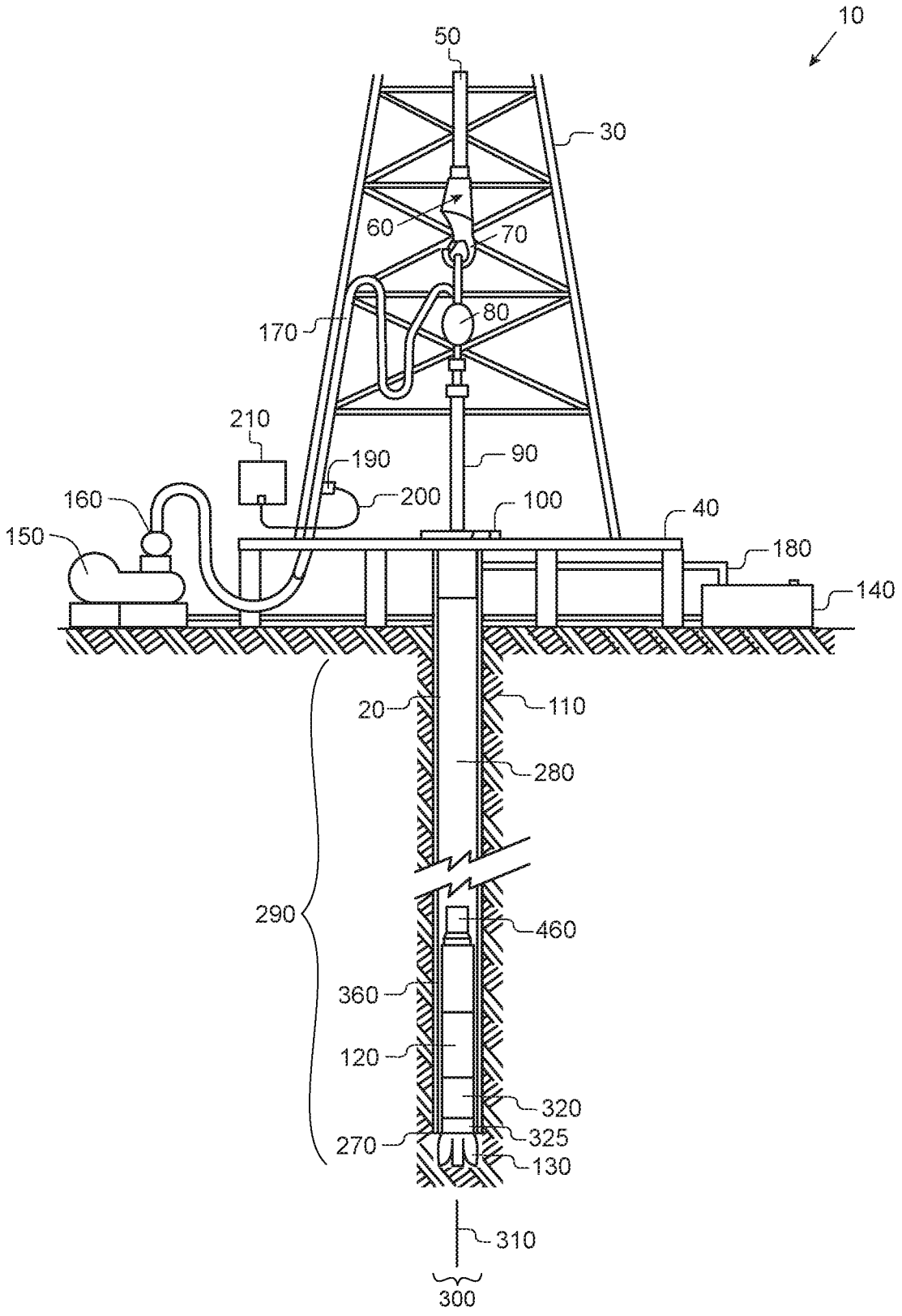
FIG. 1 is a general illustration of a preferred embodiment in accordance with the invention.

Referring to the illustrations, drawings, and pictures, and to FIG. 1 in particular, reference character 10 generally designates a new and improved casing drilling and or casing while drilling apparatus, system, kit, and method of using same constructed in accordance with the present invention for well drilling operations. Invention 10 is generally used in oil and gas well operations such as but not limited to just drilling operations. For purposes of convenience, the reference numeral 10 may generally be utilized for the indication of the invention, portion of the invention, preferred embodiments of the invention and so on.

Referring now to the drawings and specifically to FIG. 1, there is generally shown therein a simplified sketch of the apparatus used in the rotary drilling of bore holes 20 and or wells. Bore hole 20 is drilled into the earth using a rotary drilling rig, which generally consists of a derrick 30, drill floor 40, draw works 50, traveling block 60, hook 70, swivel joint 80, kelly joint 90 and rotary table 100. A casing drill string 110 used to drill the bore hole 20 is made up of multiple sections of casing that are secured to the bottom of the kelly joint 90 at the surface and the rotary table 100 is used to rotate the entire casing drill string 110 assembly while the draw works 50 is used to lower the casing drill string 110 into the bore hole 20 and apply controlled axial compressive loads.

A measurement while drilling (MWD) tool and or MWD mud pulse tool 120 is generally depicted attached to the bottom of the casing drill string 110 and a drilling bit and or drill bit 130 is attached to the bottom of the MWD tool 120. In a preferred embodiment of the invention described above, the MWD tool 120 is capable of measuring desired parameters at the bottom of bore hole 20 during the drilling process and on command, communicate these parameters, suitably encoded, to the surface using a series of pressure pulses in the circulating fluid where the pressure pulses are measured, detected, decoded and the embedded information retrieved and displayed to the driller.

The drilling fluid is usually stored in mud pits or mud tanks 140, and is sucked up by a mud pump 150, which then forces the drilling fluid to flow through a surge suppressor 160, then through a kelly hose 170, and through the swivel joint 80 and into the top of the casing drill string 110. The drill fluid flows through the casing drill string 110, through the MWD tool 120, through the drilling bit 130 and its drilling nozzles (not shown). The drilling fluid then returns to the surface. When the drilling fluid reaches the surface, it is diverted through a mud return line 180 back to the mud tanks 140.

The pressure required to keep the drilling fluid in circulation is measured by a pressure sensitive transducer 190 on the kelly hose 170. The measured pressure is transmitted as electrical signals through transducer cable 200 to a surface computer 210, which decodes and displays the transmitted information to the driller.

Figure 2:
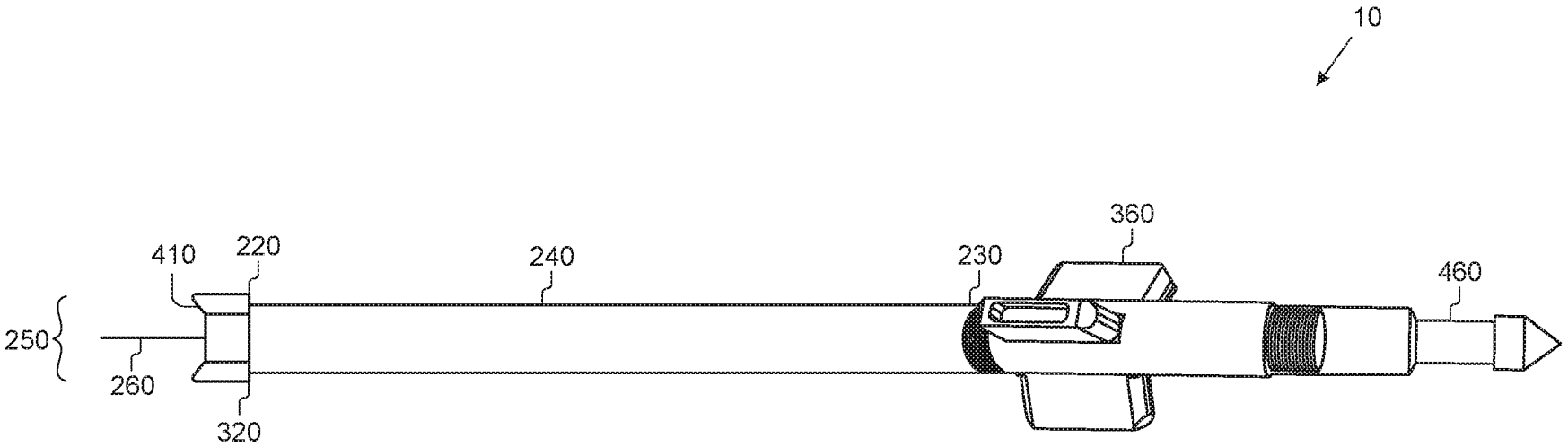
FIG. 2 is a general illustration of a preferred embodiment in accordance with the invention depicting a MWD tool.

Referring again to the illustrations and more in particularly to FIG. 2, MWD tool 120 may have a bottom 220, a top 230, a length 240, and a diameter 250 as generally defined around center axis 260 of MWD tool 120 length 240. Casing drill string 110 may also have a bottom 270 having an interior 280, a length 290 and a diameter and or inner diameter 300 as generally defined around center axis 310 of casing drill string 110 (FIG. 1).

Figure 3:
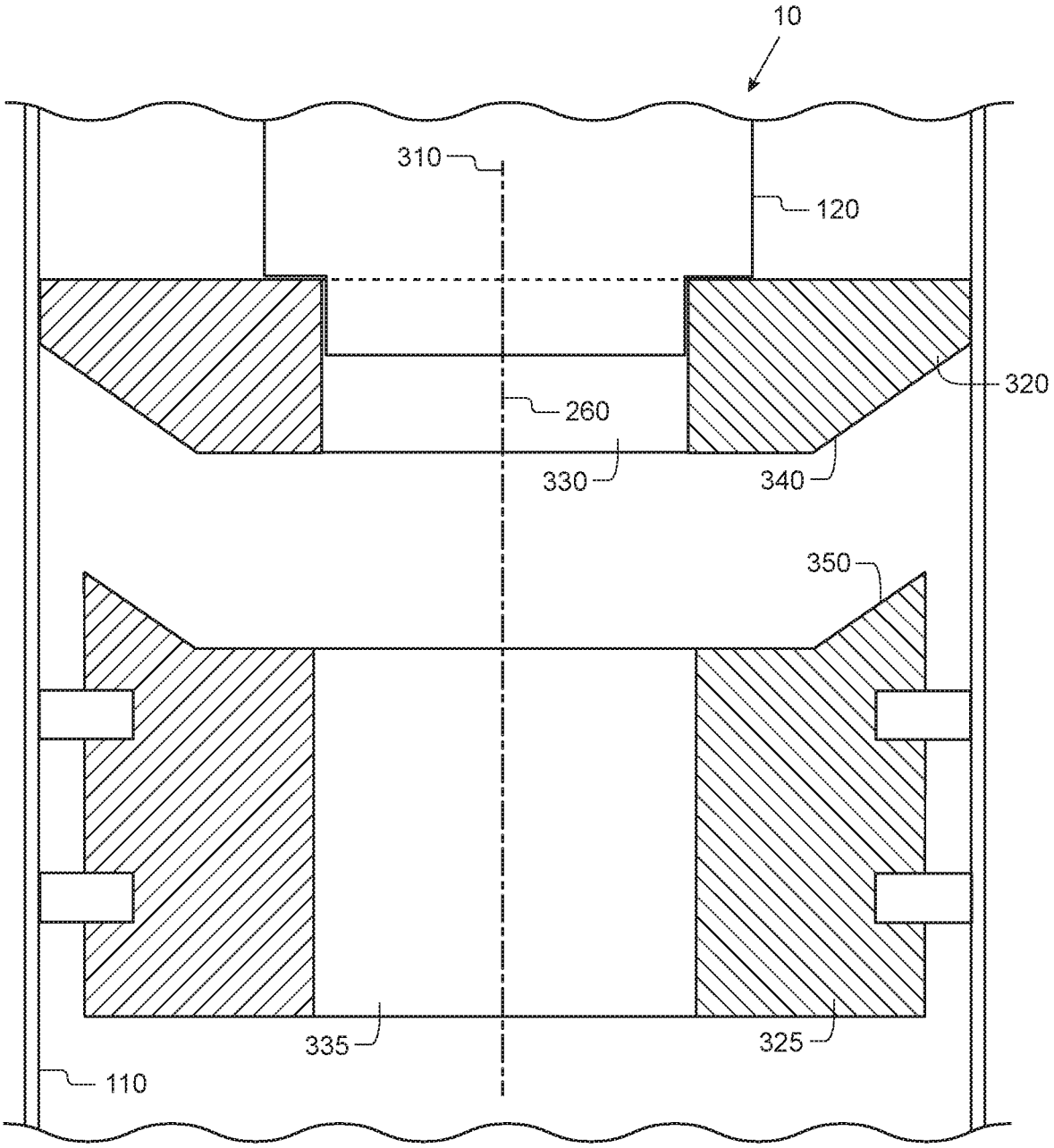
FIG. 3 is a general illustration of a preferred embodiment in accordance with the invention depicting the bottom of a MWD tool, a float shoe and a casing seal.

Generally referring to the illustrations and more in particular to FIG. 3, a float shoe 320 may generally be positioned at bottom 270 of casing drill string 110 above drilling bit 130 and adapted to generally removably hold bottom 220 of MWD tool 120 such that MWD tool 120 center axis 260 is aligned with center axis 310 of casing drill string 110. Float shoe 320 may have an aperture 330 for passing drilling fluid to the drilling bit 130 during the drilling process and also for passing oil and gas up the bore hole 20.

Float shoe 320 is generally designed to hold MWD tool 120 and return to the surface along with MWD tool 120 when desired. Float shoe 320 is generally laid and or positioned on top of a seal 325 positioned in casing 110. Seal 325 may stay downhole during production whereas float shoe 320 is removed. Seal 325 may have an aperture 335 for passing drilling fluid to the drilling bit 130 during the drilling process and also for passing oil and gas up the bore hole 20. It is contemplated that float shoe 320 may have a conical bottom 340 for removably mating with a conical indenture 350 of seal 325. It is understood that FIG. 2 float shoe 320 is generally depicting conical indenture 350 whereas the float shoe 320 of FIG. 3 is depicting another preferred embodiment with a conical bottom 340. Float shoe 320 diameter is generally about the same as casing drill string 110 diameter and or inner diameter 300.

Figure 4:
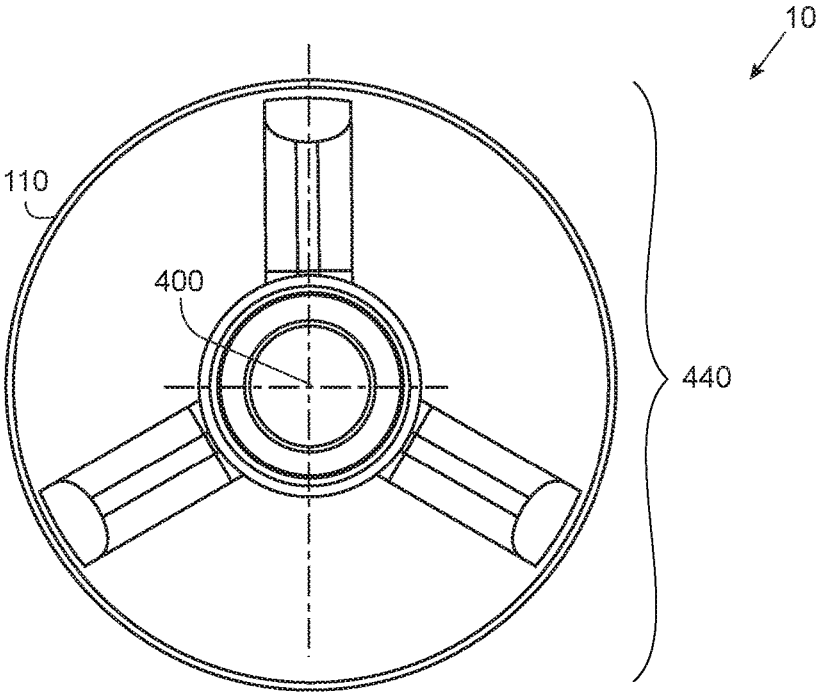
FIG. 4 is a general illustration of a preferred embodiment in accordance with the invention depicting a top view of a stabilizer in a well casing without a spear attached.
Figure 5:
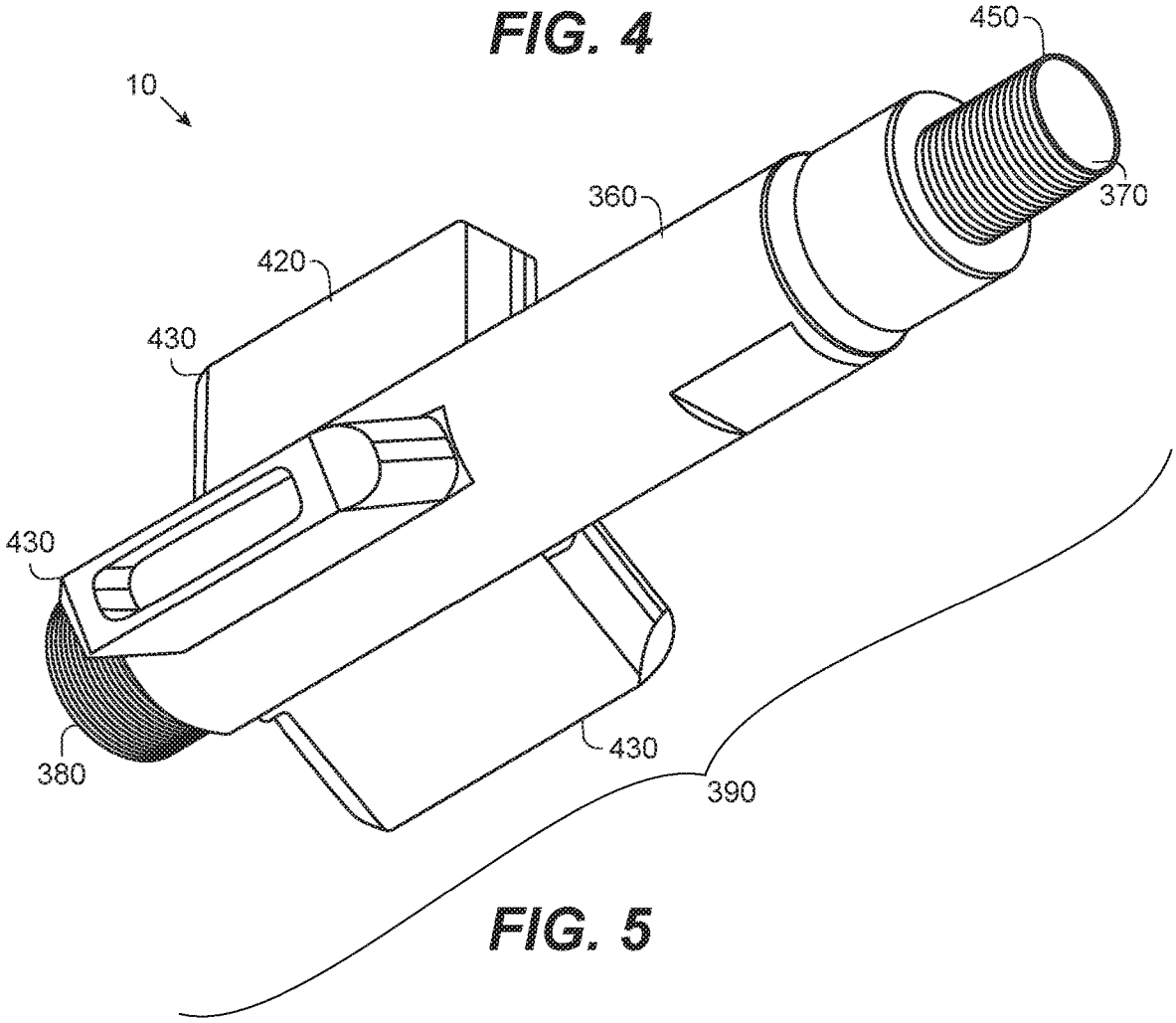
FIG. 5 is a general perspective view illustration in accordance with a preferred embodiment of the invention of a stabilizer

Again generally referring to the illustrations and more in particular to FIG. 4 and FIG. 5, invention 10 may also include stabilizer 360 having a top 370, a bottom 380 and a length 390 with an axis 400 defined along length 390. Stabilizer bottom 380 may be attached to top 230 of MWD tool 120 and generally positioned on top 230 of MWD tool 120 with center axis 260 aligned with center axis 310 of casing drill string 110. Stabilizer 360 may have mating threads 450 that thread onto MWD tool 120, which may have corresponding threads 410 (FIG. 2).

Stabilizer 360 may have positioning assembly 420 with a preferred embodiment being three fins 430 although more and less are contemplated. It is contemplated to provide at least two fins 430. Fins 430 may have a diameter and or outer diameter 440 such that the stabilizer 360 keeps MWD 120 generally axially aligned in casing drill string 110 but allows for retrieval up casing drill string 110 with fin 430 outer diameter 440 somewhat smaller than casing drill string 110 inner diameter 300. Stabilizer 360 may have top 370 with threads 450 for joining. It is understood that stabilizer 360 may not include fins 430 but may generally have a configuration such as but not limited to float shoe 320.

Figure 6:
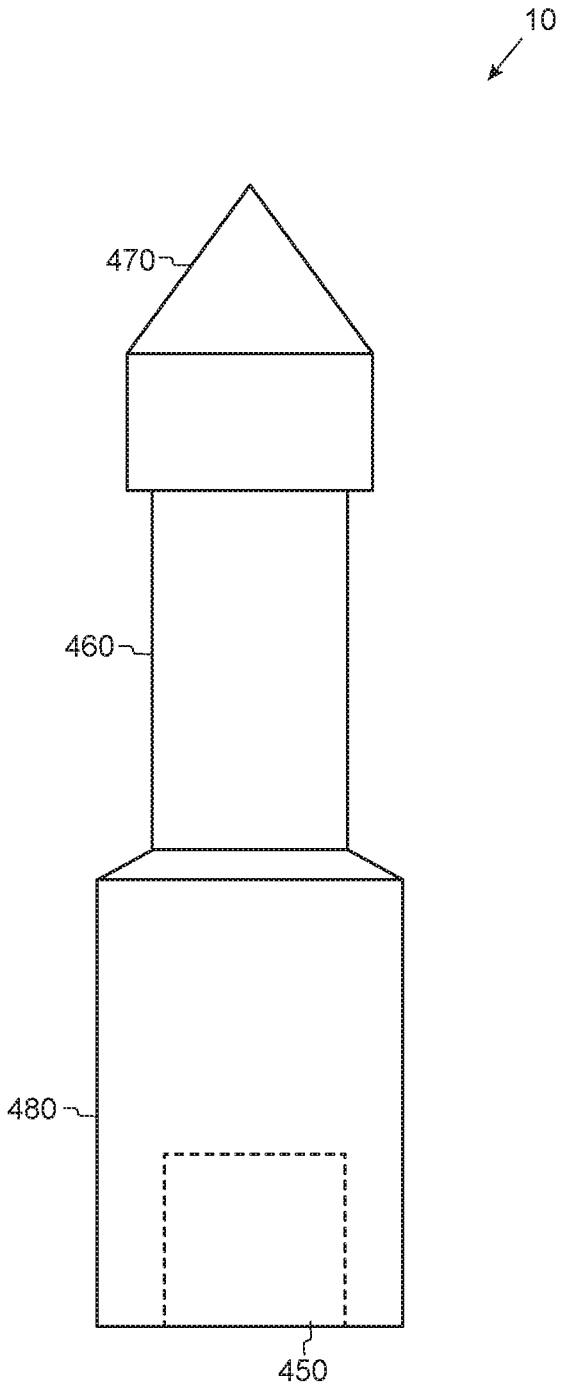
FIG. 6 is a general side illustration of a preferred embodiment in accordance with the invention generally depicting a spear.

Generally referring to FIG. 6, in a preferred embodiment, invention 10 may include a spear 460 having a top 470 adapted to attach to a retrieval system as known in the art and a bottom 480, which may have threads for mating with stabilizer 360 top 370 threads 450.

Invention 10 therefore contemplates a casing while drilling system comprising a casing having a length with a center axis, a bottom with a drill bit, and said casing have a diameter perpendicular to said center axis; a seal having a top, a bottom, and an aperture there through wherein said seal is positioned in said length of said casing above said drill bit; a MWD mud pulse tool having a top, a length along said center axis, a bottom, a diameter perpendicular to said center axis, and wherein said diameter of said MWD mud pulse tool is about the same as a diameter of a drill string; a float shoe having a first end adapted to be removably positioned on said top of said seal, a length with an aperture there through, a second end attached to said bottom of said MWD mud pulse tool, a diameter perpendicular to said center axis, and wherein said diameter of said float shoe is about the same as said diameter of said casing; and a stabilizer having a first end adapted to be removably attached to said top of said MWD mud pulse tool, a length, a second end adapted to communicate with a down hole retrieval system, a diameter perpendicular to said center axis, and wherein said diameter of said stabilizer is about the same as said diameter of said casing.

Invention 10 also therefore contemplates said second end of said stabilizer has an attached spear; said diameter of said casing is at least 5½ inches; said diameter of said MWD mud pulse tool is less than 5½ inches; and said stabilizer may include at least two fins perpendicularly attached to said length of said stabilizer.

Changes may be made in the combinations, operations, and arrangements of the various parts and elements described herein without departing from the spirit and scope of the invention. Furthermore, names, titles, headings and general division of the aforementioned are provided for convenience and should, therefore, not be considered limiting.

What is claimed is:

1. A casing while drilling system comprising:

a casing drill string having a length with a center axis, a bottom with a drill bit, and said casing drill string having a diameter perpendicular to said center axis;

a seal having a top, a bottom, and an aperture there through wherein said seal is positioned in said length of said casing drill string above said drill bit;

a measurement while drilling mud pulse tool having a top, a length along said center axis, a bottom, a diameter perpendicular to said center axis, and wherein said diameter of said measurement while drilling mud pulse tool is less than said diameter of said casing drill string;

a float shoe having a first end adapted to be removably positioned on said top of said seal, a length with an aperture there through, a second end attached to said bottom of said measurement while drilling mud pulse tool, a diameter perpendicular to said center axis, and wherein said diameter of said float shoe is about the same as said diameter of said casing drill string;

a stabilizer having a first end adapted to be removably attached to said top of said measurement while drilling mud pulse tool, a length, a second end adapted to communicate with a down hole retrieval system, a diameter perpendicular to said center axis, and wherein said diameter of said stabilizer is about the same as said diameter of said casing drill string.

2. The casing while drilling system of claim 1 wherein said second end of said stabilizer has an attached spear.

3. The casing while drilling system of claim 1 wherein said diameter of said casing drill string is at least 5½inches.

4. The casing while drilling system of claim 3 wherein said diameter of said measurement while drilling mud pulse is less than 5½inches.

5. The casing while drilling system of claim 1 wherein said stabilizer may include at least two fins perpendicularly attached to said length of said stabilizer.

* * * * *